US007524201B2

(12) United States Patent
Ralph et al.

(10) Patent No.: US 7,524,201 B2
(45) Date of Patent: Apr. 28, 2009

(54) LOW-COST CABLE CONNECTING SYSTEM FOR MOVABLE/SEPARABLE ELECTRONIC DEVICES

(75) Inventors: James R. Ralph, Wilton, CT (US); Christopher DeBarber, Woodbury, CT (US); Neil F. Baldino, Sandy Hook, NY (US)

(73) Assignee: Pitney Bowes Inc., Stamford, CT (US)

( * ) Notice: Subject to any disclaimer, the term of this patent is extended or adjusted under 35 U.S.C. 154(b) by 123 days.

(21) Appl. No.: 11/837,684

(22) Filed: Aug. 13, 2007

(65) Prior Publication Data

US 2008/0096418 A1 Apr. 24, 2008

Related U.S. Application Data

(60) Provisional application No. 60/853,138, filed on Oct. 20, 2006.

(51) Int. Cl.
*H01R 3/00* (2006.01)

(52) U.S. Cl. ..... 439/162; 174/153 G

(58) Field of Classification Search ..... 439/162; 174/153 G

See application file for complete search history.

(56) References Cited

U.S. PATENT DOCUMENTS 6,517,365 B1 * 2/2003 Bungo et al. ..... 439/162
6,660,937 B1 * 12/2003 MacLeod et al. ..... 174/153 G
6,682,353 B2 * 1/2004 Bigotto ..... 439/34

* cited by examiner

*Primary Examiner*—Tho D Ta
(74) *Attorney, Agent, or Firm*—Brian A. Collins; Angelo N. Chaclas

(57) ABSTRACT

A system for electrically connecting first and second electronic devices wherein the devices are movable relative to each other. The system includes an electric cable having end segments and a medial segment therebetween wherein each of the end segments connects to one of the first and second electronic devices. A tensioning mechanism maintains a tensile load on the medial segment of the electric cable while a guide mechanism directs movement of the electric cable in response to relative motion between the first and second electronic devices. Moreover, a strain relief mechanism is operative to mitigate the transmission of tensile loads from the medial segment to either of the end segments such that the end segments are substantially unloaded in response to movement of the devices.

18 Claims, 6 Drawing Sheets

LOW-COST CABLE CONNECTING SYSTEM FOR MOVABLE/SEPARABLE ELECTRONIC DEVICES

RELATED APPLICATIONS

This application claims the benefit under 35 U.S.C. 119(e) of U.S. provisional patent application: Ser. No. 60/853,138 filed Oct. 20, 2006 and entitled "CABLE RETRACTION SYSTEM"; which is incorporated herein by reference.

FIELD OF THE INVENTION

This invention relates to a system and method for connecting electronic devices and, more particularly, to a system and method for electrically connecting devices having a requirement to be moved or separated during routine business operations.

BACKGROUND OF THE INVENTION

Recently, innovations in the area of "printing-on-demand" and "just-in-time printing" have permitted the integration/combination of high-speed printers (both black & white and color) with automated mailpiece processing equipment or mailpiece inserters. Examples of such integrated systems are high capacity DI 900 and DI 950 desktop inserters such as those manufactured by Pitney Bowes Inc., located in Stamford, Conn., USA. These mailpiece inserters combine high quality printers, such as the HP 4350 (Black and White) and HP 4700 (Color) manufactured by Hewlett Packard Corporation, with state-of-the-art Pitney Bowes Inc. insertion systems. Such systems can be expanded to include upstream modules that add the functions of high capacity feeding, collating of sheets and booklets, and on-demand printing.

Typically, these printers are integrated in combination with a page buffer module of the inserter. The integration often requires modification of the paper feed path and/or the printer output tray to feed pages, both single-sided and duplex, to the page buffer. Furthermore, the printer commonly includes a base which engages a telescoping guide track to accommodate physical separation of the printer and inserter. Moreover, the mechanical interface between the printer and inserter includes a variety of quick-connect/disconnect latching mechanisms to facilitate separation. As such, should the printer or page buffer require maintenance or encounter a paper jam, the printer can be quickly disconnected (i.e., mechanically) and rolled away or apart from the inserter to permit access to the necessary internal components.

While a variety of mechanical latching devices can be reliably implemented at relatively low-cost, electrical connectors, capable of performing the same task, are, generally, more costly to implement. For example, it will be appreciated that relatively high manufacturing tolerances, and consequently, high machining costs, are required to ensure proper alignment and electrical continuity of a multi-pin electrical connection. Hence, with respect to the desktop inserter described above, tolerances associated with the printer's telescoping roller base must be held tightly to provide a reliable plug-in type electrical connection.

Alternatively, a connection can be maintained by a continuous, end-to-end, cable connection, e.g., a wiring harness of sufficient length to accommodate the full separation distance between the printer and inserter, however, an additional length of slack cable must be available. In addition to the difficulties controlling the cable, including safety issues, bending strain may be introduced which can reduce the fatigue life of the cable connection.

A need therefore exists for a reliable, low-cost, cable connecting system for electronic devices which are moveable/separable.

SUMMARY OF THE INVENTION

A system is provided for electrically connecting first and second electronic devices wherein the devices are movable relative to each other. The system includes an electric cable having end segments and a medial segment therebetween wherein each of the end segments connects to one of the first and second electronic devices. A tensioning mechanism maintains a tensile load on the medial segment of the electric cable while a guide mechanism directs movement of the electric cable in response to relative motion between the first and second electronic devices. Moreover, a strain relief mechanism is operative to mitigate the transmission of tensile loads from the medial segment to either of the end segments such that the end segments are substantially unloaded in response to movement of the devices.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

The present invention will be described in the context of a mailpiece insertion system having an integrated printer. Although, the invention is applicable to any system having two or more electronic devices which, during the course of use and/or maintenance, must occasionally and/or temporarily be separated, i.e., moved relative to each other. Furthermore, the devices remain electrically connected during movement and/or separation.

Figure 1:
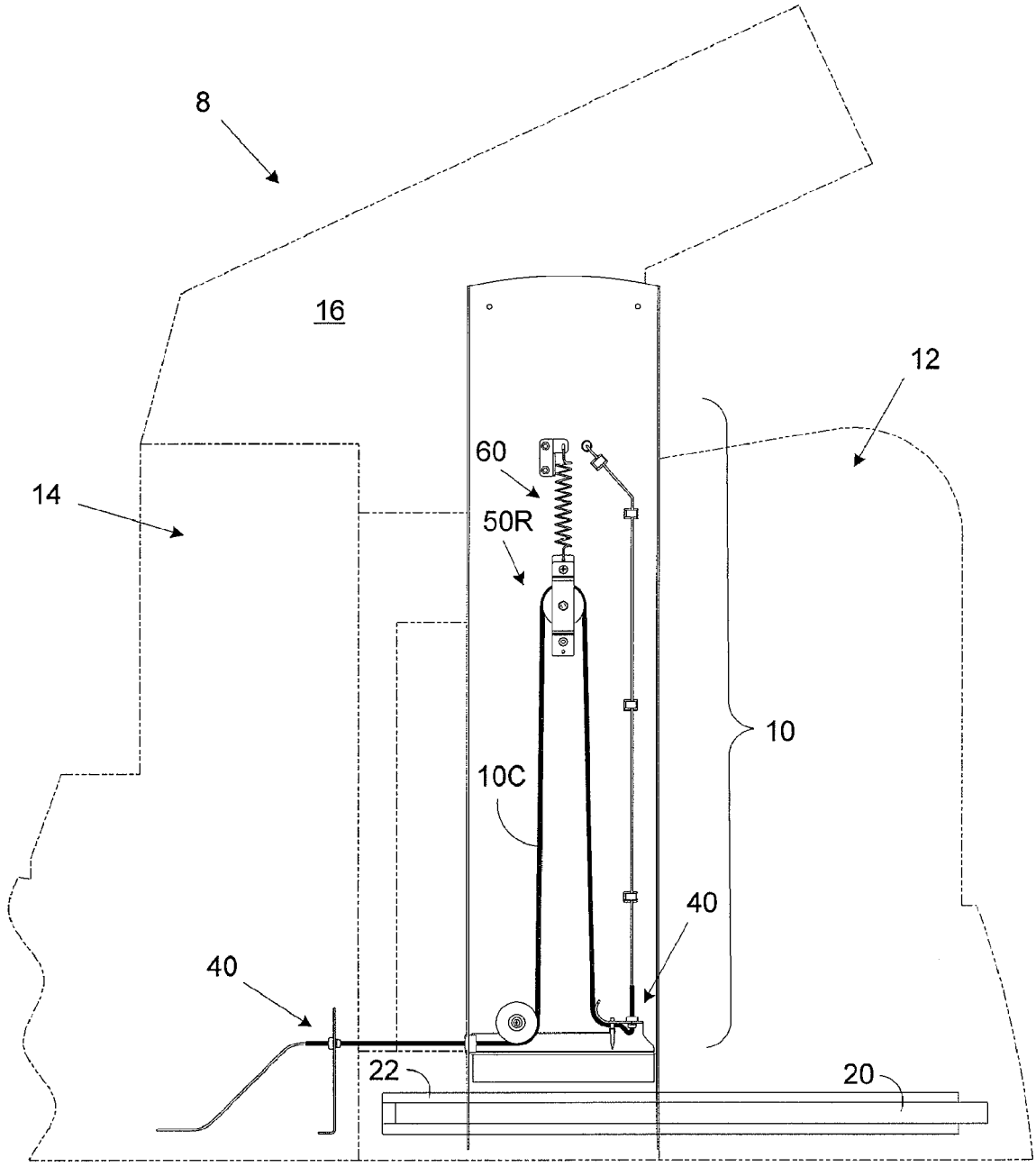
FIG. 1 depicts a partially broken-away schematic side view of a table-top or desktop mailpiece inserter including a cable connecting system according to the present invention which accommodates separation and/or relative motion between at least two electrically connected modules of the mailpiece inserter.

In FIG. 1, a broken-away schematic side view of a mailpiece inserter 8 is shown including a cable connecting system 10 according to the present invention. The cable connecting system comprises a printer 12 and an inserter 14 including a page buffer module 16. In the context used herein, the term "cable" means any wire, wiring harness, conduit, filament, or group of filaments capable of conducting electricity or carrying an electric current. The printer 12 includes a base 20 which is guided and rolls within a linear track 22. In the described embodiment, the base 20 and guide track 22 telescope outwardly from the inserter 14 such that the printer 12 may be separated from the page buffer module 16 to provide access therebetween, i.e., as may be necessary to clear paper jams or perform routine maintenance. While, in the described embodiment, the cable connecting system 10 is integrated in combination with the printer 12, the system 10 may be integrated with the inserter 14 or page buffer module 16. That is, the cable connecting system 10 may be connected to, and move with, either electronic device, i.e., the printer 12 or the inserter 14.

Figure 2:
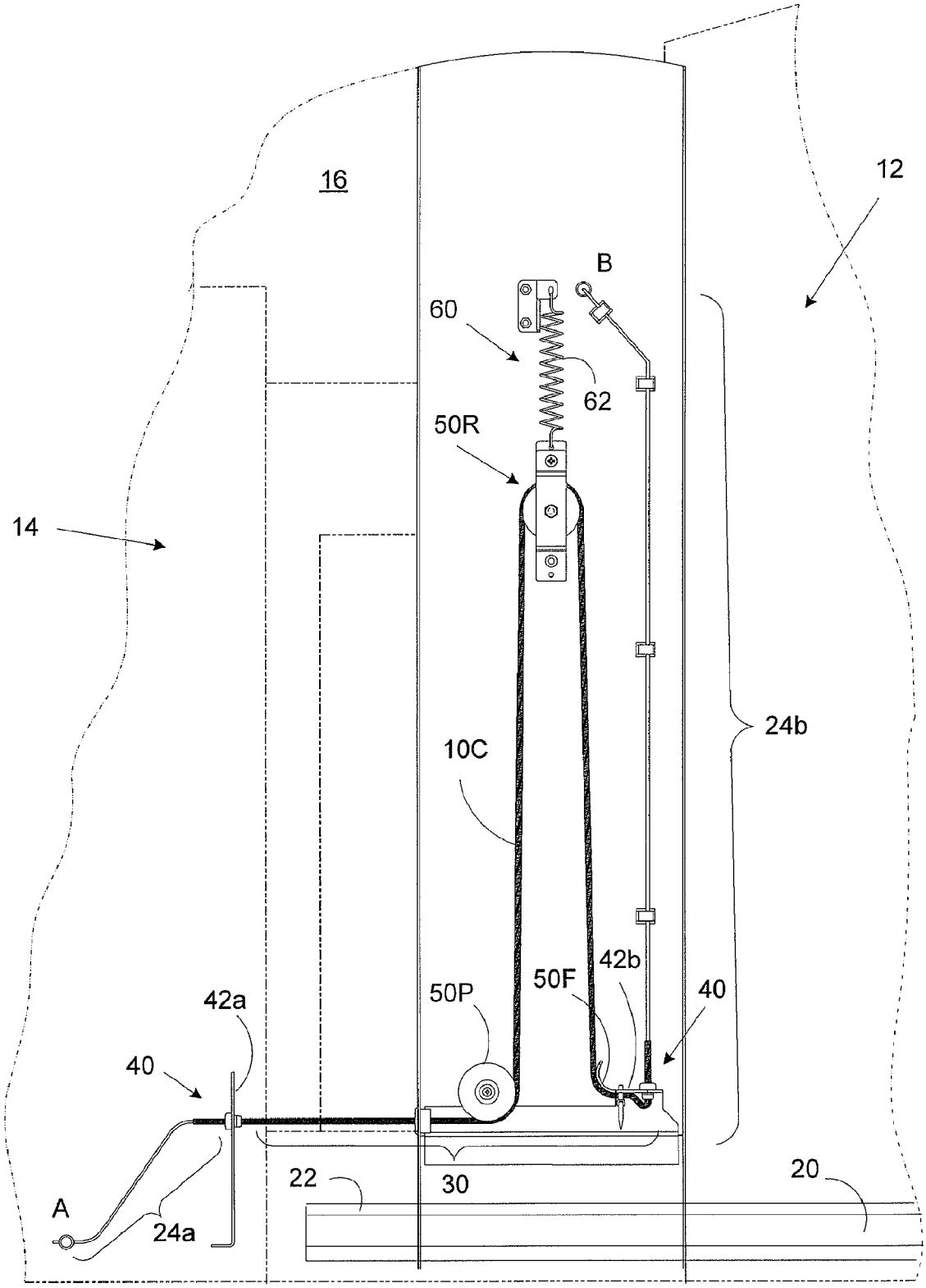
FIG. 2 is an enlarged view of the cable connecting system according to the present invention including an electric cable having end segments and a medial segment therebetween; a tensioning mechanism to maintain a tensile load on the medial segment; a guide mechanism to guide the electric cable, and a strain relief mechanism to mitigate the transmission of tensile loads from the medial segment to each or either of the end segments.

In FIG. 2, the cable connecting system 10 includes an electric cable having segments 24*a*, 24*b* and a medial segment 30 disposed therebetween. The cable connecting system 10 electrically connects the printer 12 to the inserter 14 without interruption or the need for a disconnect/reconnect assembly such as a plug or pin connector. Functionally, the connecting cable 10 transmits signals from the inserter 14 to the printer 12 in response to a requirement or "call" for additional printed pages, i.e., based upon the throughput requirements or availability of space in the page buffer 16. The "print-on-demand" function is a recent development in the art of mailpiece inserters 8 and is described in greater detail in commonly owned, co-pending patent application Ser. No. 11/731,373, entitled "Print Interface System for a Sheet Handling Device", which is hereby incorporated by reference in its entirety.

The electric cable 10C of the cable connecting system 10 extends from a point A associated with the mailpiece inserter 14 to a point B associated with the integrated printer 12. More specifically, a first of the end segments 24*a* is electrically connected to the inserter 14 at an end opposing its connection to the medial segment 30 and a second of the end segments 24*b* is electrically connected to the printer 12 at an end opposing the medial segment 30. While the connection between the end segments 24*a*, 24*b* and the medial segment 30 is essentially integral and uninterrupted, it is useful to define the segments 24*a*, 24*b*, 30 as separate regions or segments due to the loading and/or operation of each of the segments 24*a*, 24*b*, 30.

Figure 3B:
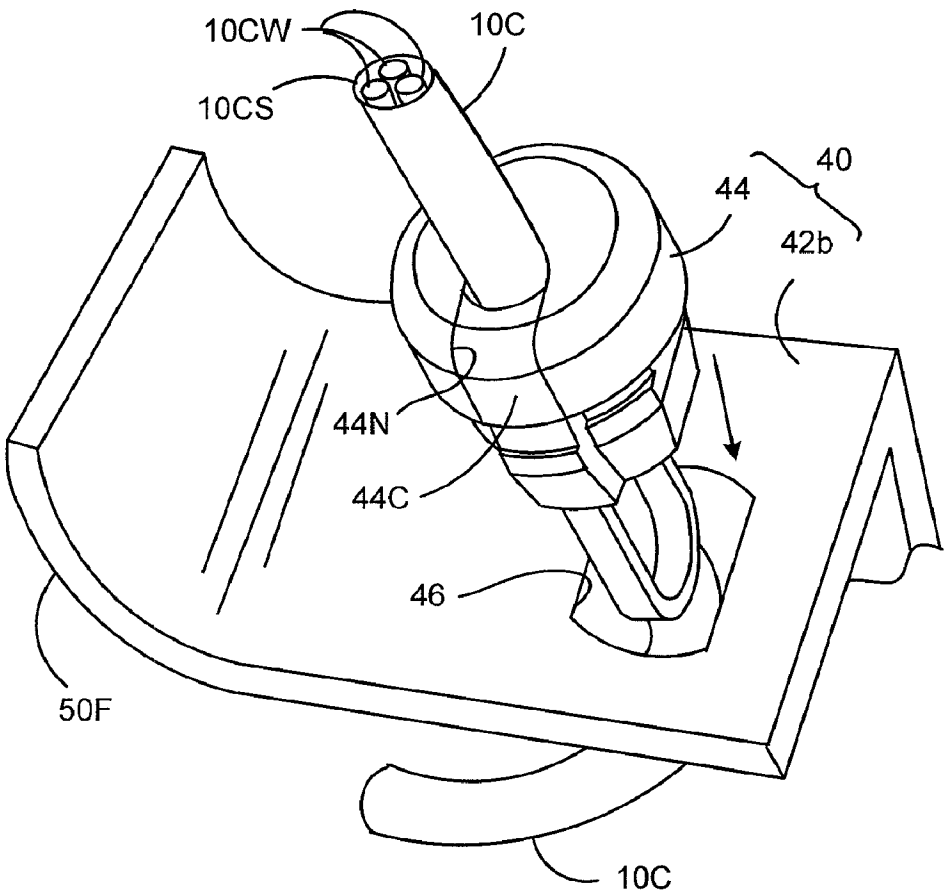
FIG. 3*b* is an isolated perspective view of the strain relief mechanism including the strain relief fitting disposed in combination with a structural flange.
Figure 3A:
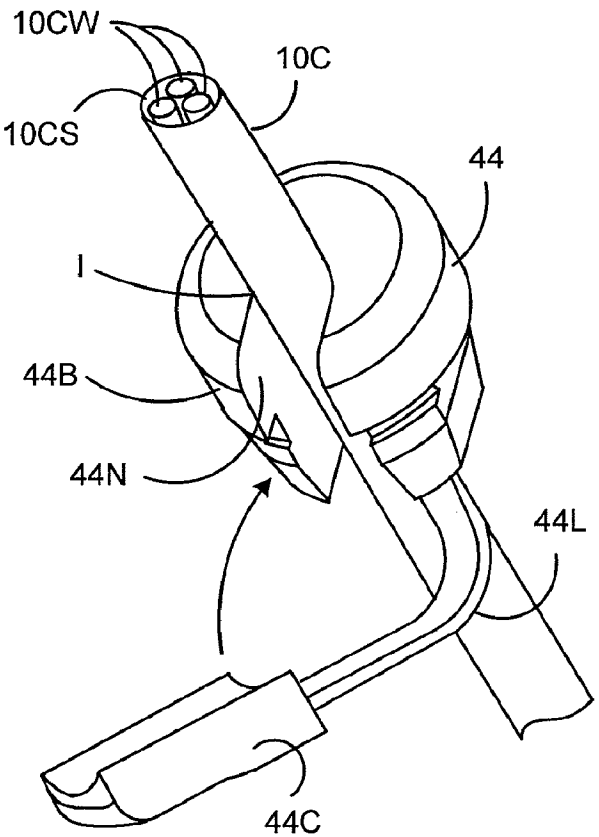
FIG. 3*a* is an isolated perspective view of a strain relief fitting employed in the strain relief mechanism of the inventive cable connecting system.

In FIGS. 2 and 3*a*, the electric cable 10C includes a bundle of individual wires 10CW (see FIG. 3*a*), e.g., a twisted pair of wires, for carrying electrical signals to and/or from the printer 12 and inserter 14. The individual wires 10CW are surrounded by or disposed within a protective sheath 10CS. The protective sheath 10CS may be fabricated from a variety of resilient elastomer, thermoplastic or fiber-reinforced resin matrix composite materials. In the described embodiment, the protective sheath 10CS is fabricated from a resilient polyvinyl chloride material, also known as "PVC" tubing, and has the necessary strength and modulus (elongation) characteristics to provide the desired protective properties for the internal wire bundle.

At each interface, between the medial segment 30 and each of the end segments 24*a*, 24*b*, is a strain relief mechanism 40 comprising a structural flange 42 and strain relief fitting 44. A first structural flange 42*a* projects outwardly from the inserter 14 and is disposed in a substantially vertical orientation. A second structural flange 42*b* projects outwardly from the printer 12 and is disposed in a substantially horizontal orientation. Each of the flanges 42*a*, 42*b* includes an aperture 46 for accepting the strain relief fitting 44. In FIGS. 3*a* and 3*b*, each strain relief fitting 44 includes a cylindrical body 44B having radial notch 44N formed therein for accepting the cable 10C. The radial notch 44N extends the length of the body 44B, i.e., from one end to the other, and is sufficiently deep to center the cable 10C within the cylindrical body 44B. Furthermore, the fitting 44 includes a clamp restraint 44C which is tied to an underside portion of the body 44B via a flexible lanyard 44L.

In FIGS. 3*a* and 3*b*, the cable 10C is drawn though or is seated within the notch 44N of the fitting 44, i.e., pressing the cable 10C laterally in the direction of arrow 1. An end of the cable 10C is passed through the aperture 46 of the respective structural flange 42*a* or 42*b* (FIG. 3*b* depicts the structural flange 42*b* associated with the printer 12, though both flanges 42*a*, 42*b* are essentially identical in terms of there structure and function). The aperture 46 and periphery 44P of the fitting 44 form an interference fit such that a clamping force restrains the cable relative to the respective flange 42*b*. More specifically, as the aperture 46 receives the fitting 44, the clamp restraint 44C seats within a radial notch 44N of the fitting and is pressed against the sheath 10CS of the cable 10C. The clamp restraint 44 deforms the sheath 10CS and forms a mechanical interlock therebetween such that tensile loads in the medial segment 30 of the cable 10C are transferred to the respective flanges 42*a*, 42*b*, rather than across the sheath 10CS, i.e., from one side of the cable to the other. That is, a load path is established from the sheath 10CS, across the fitting 44 and to the respective flange 42*a*, 42*b*.

Figure 4:
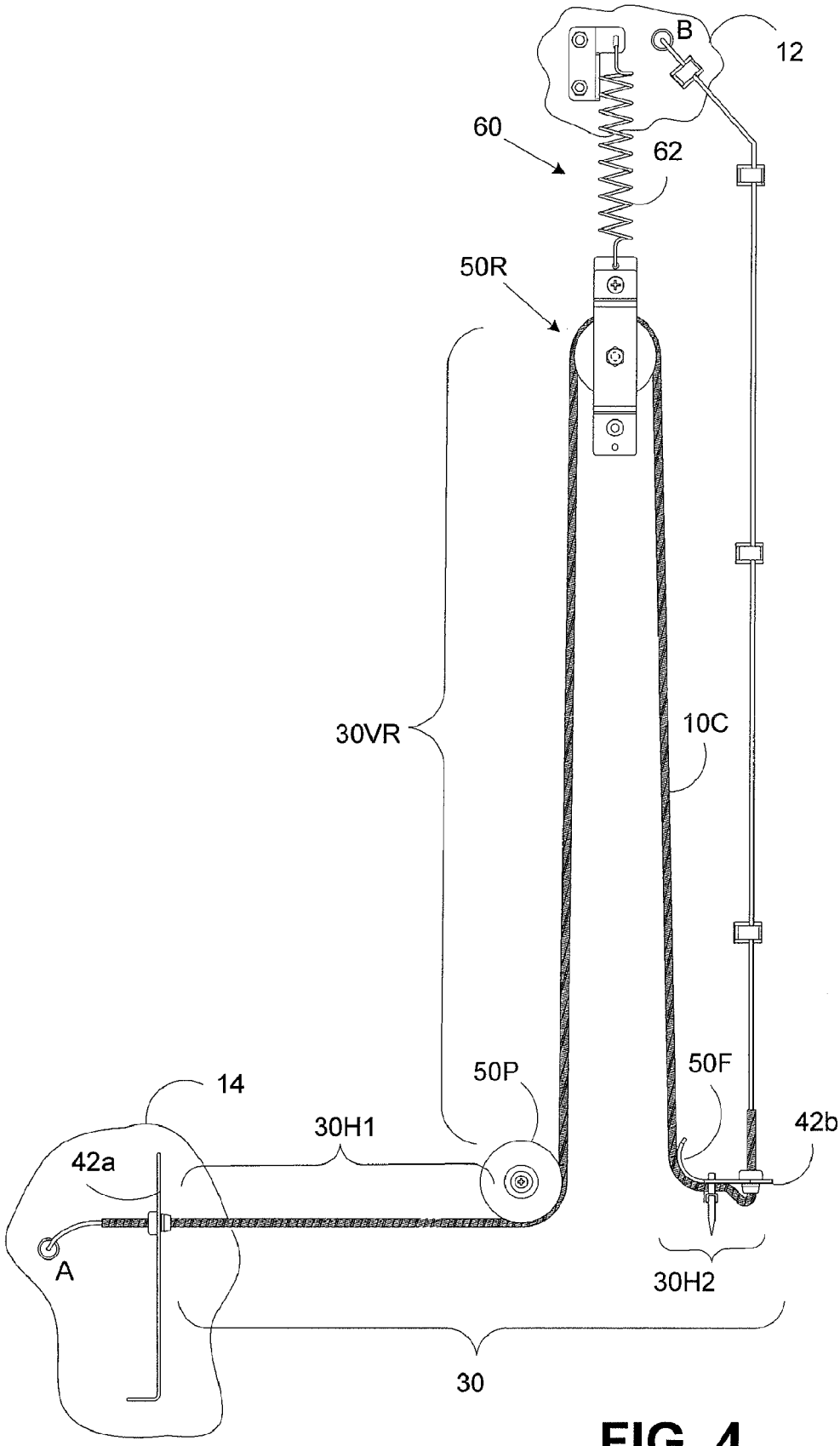
FIG. 4 is an enlarged illustration of the cable connecting system including the tensioning mechanism for imposing a tensile load on the medial segment of the cable and for controlling cable slack when the electrically connected modules are in close proximity, e.g., mechanically coupled.

Returning to a broader discussion of the inventive connecting system 10 and referring to FIG. 4, the medial segment 30 of the electric cable extends between the flanges 42*a*, 42*b* and is redirected via a system of guides 50 to define a pair of horizontal segments 30H1, 30H2 and a recurved vertical segment 30VR. More specifically, the first and second horizontal segments 30H1, 30H2 are directed around a right-angle guide, i.e., a pulley 50P and a right-angle flange 50F, and transition to the recurved vertical segment 30VR. The vertical segment 30VR is redirected about a return pulley 50R, i.e., approximately one-hundred and eighty degrees (180 degrees) and is recurved for connecting to each of the horizontal segments 30H1, 30H2. Inasmuch as only the recurved segment 30VR and one of the horizontal segments 30H1 experiences motion, i.e., a change in length, upon separation of the printer and inserter (seen in FIG. 5), these segments are guided by pulleys which rotate. On the other hand, the opposing horizontal segment 30H2 is essentially stationary with respect to the right-angle guide. Consequently, a simple non-rotating right-angle flange 50F may be employed.

The return pulley 50R connects to a tensioning mechanism 60 which imposes a vertical force on the medial segment 30 of the cable 10C, and more particularly, on the recurved vertical segment 30VR thereof. In the described embodiment, the tensioning mechanism 60 includes a coil spring 62 mounting at one end thereof to a stationary housing portion of the printer 12 and at the other end to the return pulley 50R. Furthermore, the coil spring 62 has a spring rate constant of between about 0.8 lb/inch to about 1.0 lb/inch, is capable of extending (max.) between about ten inches (10") to about fourteen inches (14") inches and produces a linear force (max.) with a range of about eight pounds (8 lbs.) to fourteen pounds (14 lbs.). While the tensioning mechanism 60 is shown as a coil spring 62, other biasing mechanisms may be employed. For example, one or more bands of elastomer may be substituted for the coil spring 62. Alternatively, a compression spring, i.e., biasing the return guide pulley 50R upwardly may also be employed to apply a tensile load. Additionally, a pneumatic or air spring may be employed within the meaning of a tensioning mechanism.

Figure 5:
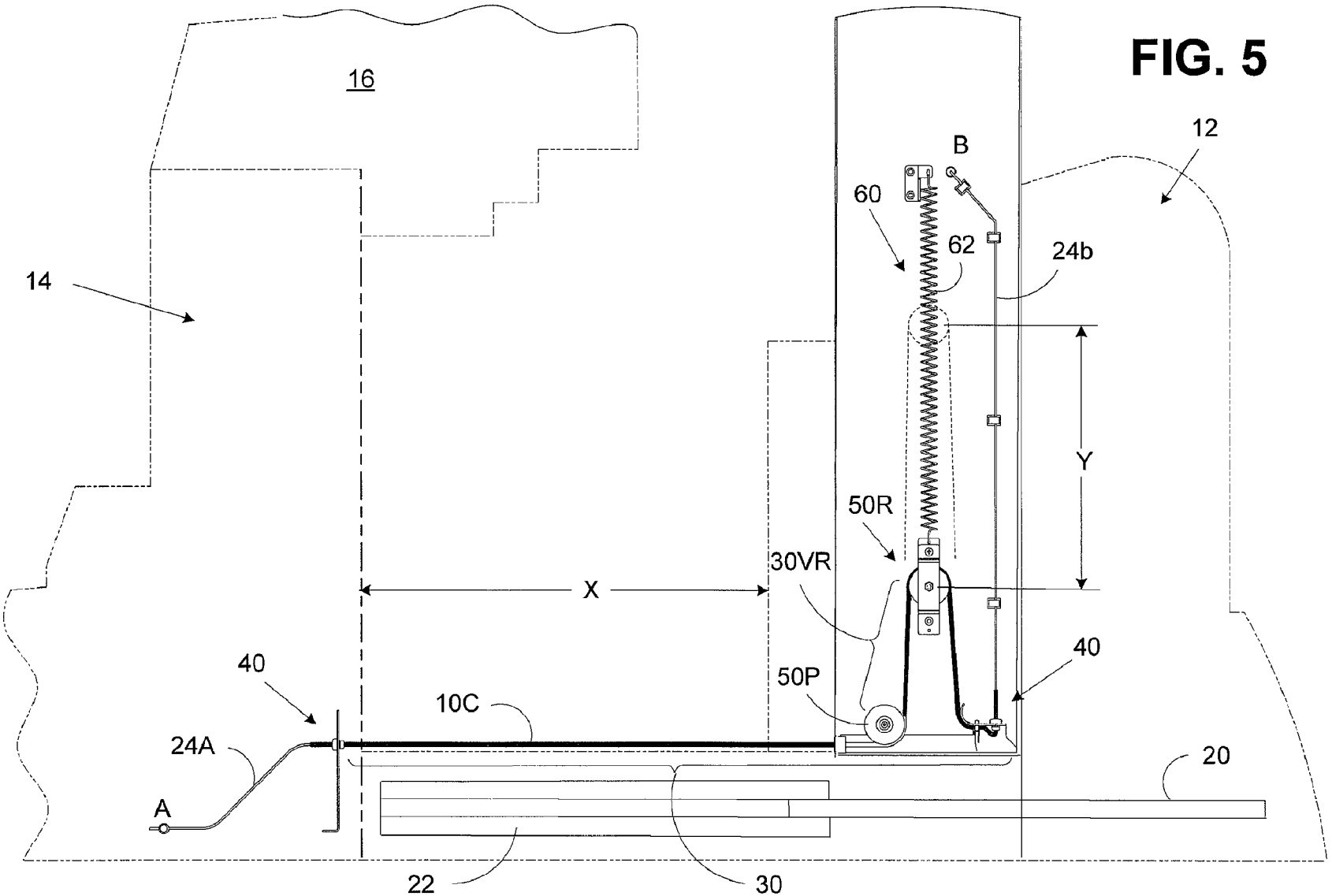
FIG. 5 depicts the desktop inserter and cable connecting system of FIG. 1 wherein the cable connecting system is extended to permit separation of the modules while remaining electrically connected.

In FIG. 5, the printer 12 and inserter 14 have been separated a distance X to provide access therebetween. As mentioned earlier, such relative movement may be necessary to clear a paper jam or perform routine maintenance. In operation, the base 20 of the printer 12 telescopes outwardly and achieves a total separation of about three (3') to four (4') feet. The horizontal motion of the printer 12 is accommodated by the vertical translation Y in the recurved segment 30VR of the cable 10C. More specifically, the tensioning mechanism 60 applies a tensile load to the medial segment 30 of the cable 10C and, with the assistance of the guide mechanism, e.g., guide pulley 50R, 50P and/or guide flange 50F, controls/guides the additional cable length necessary to move the printer 12 relative to the inserter 14. Moreover, the tensile loading of the tensioning mechanism 60 is not transmitted from the medial segment 30 to either end segment 24*a*, 24*b*. That is, the strain relief mechanisms 40 transfer the tensile loads from the cable sheath 10CS (see FIG. 3*b*), across the strain relief fitting 44, to the structural flanges 42*a*, 42*b* associated with the printer 12 and inserter 14. Finally, the absence of any tensile, vibratory or fatigue loads in the end segments 24*a*, 24*b* of the cable connecting system provides for a long-lasting reliable electrical connection. That is, the connection at points A and B associated with the inserter 14 and printer 13, respectively, are substantially unloaded.

Generally, the tensioning mechanism 60 will act, i.e., apply a load or force, at right-angles to the forces effecting separation of the printer 12 and inserter 14, i.e., the forces which separate the devices along a separation path. Although, it should be appreciated that the loads and forces acting on the cable 10C can be oriented at other angles; however, the tensile loading on the cable may be higher as a consequence.

Figure 6:
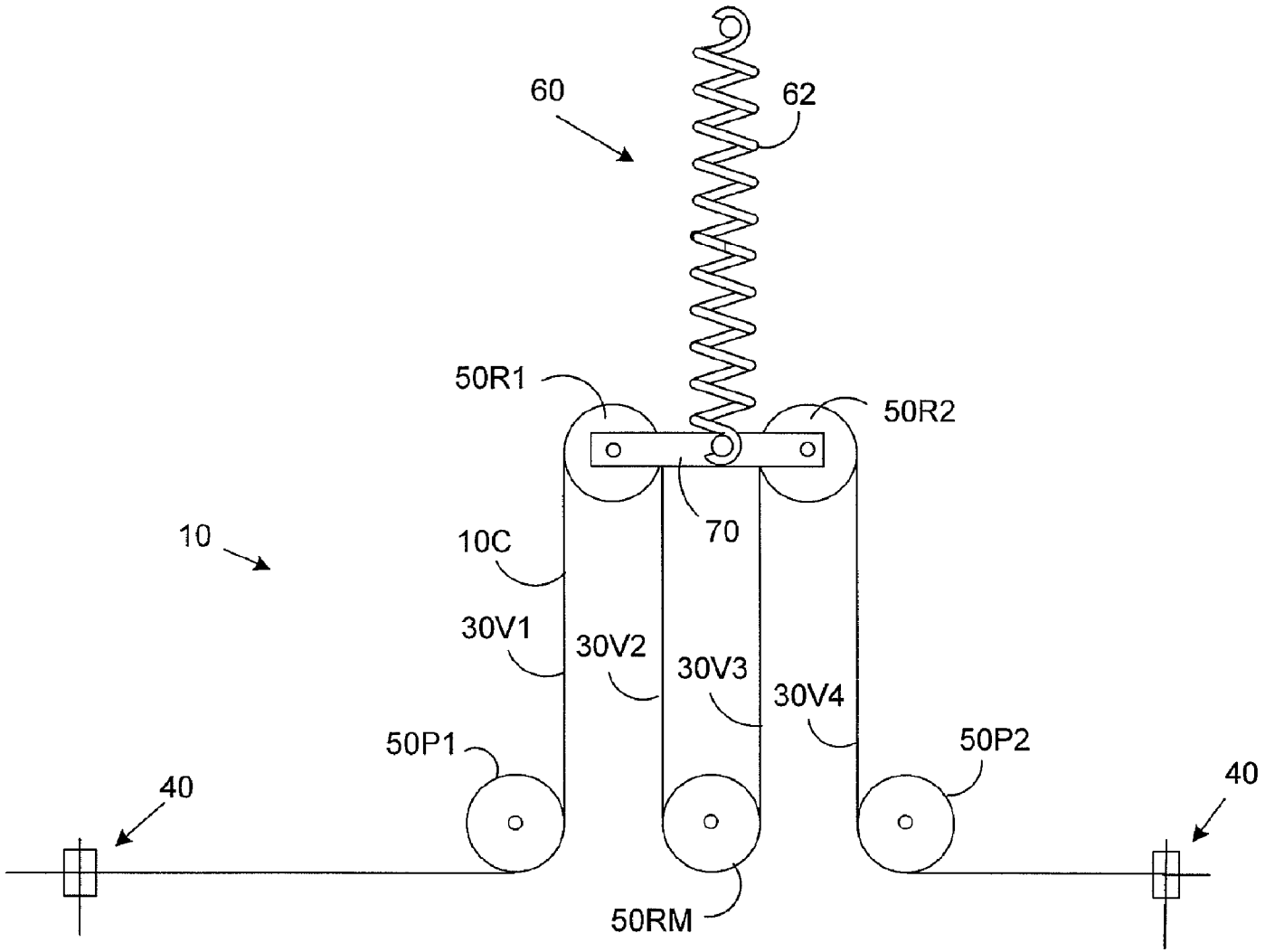
FIG. 6 depicts an alternate embodiment of the guide and tensioning mechanisms including a plurality of guide pulleys which have been coupled to reduce the height or vertical length requirements of the cable connecting system.

The cable connecting system 10 of the present invention employs a guide mechanism to form equal length cable segments on each side of the return pulley 50R. The resulting recurved vertical segment 30VR provides a mechanical and length advantage of two-to-one (2:1). This ratio mitigates the vertical space requirements for achieving the horizontal separation distance between the printer 12 and inserter 14. While a single return pulley can halve the vertical space requirements, a cable connecting system 10 having two or more return pulleys, such as the system 10 schematically depicted in FIG. 6, can reduce the space requirements yet further. For example, a cable connecting system 10 may include a pair of return pulleys 50R1 50R2, a pair of right-angle pulleys 50P1, 50P2, and an intermediate return pulley 50RM. Tension is applied to the upper pair of return pulleys 50R1, 50R2 by a cross-beam member 70 which is connected to the coil spring 62 of the tensioning mechanism 60. This system can effectively quarter the vertical space requirements inasmuch as the configuration produces four vertical cable segments 30V1, 30V2, 30V3 and 30V4.

While preferred embodiments of the invention have been described and illustrated above, it should be understood that these are exemplary of the invention and are not to be considered as limiting. For example, while the guide and mechanisms, 50R, 50P, 50F, 60 are disposed in combination with the printer 12, it will be appreciated that these same mechanisms may be combined with the inserter 14. Furthermore, other additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A system for electrically connecting first and second electronic devices, the first and second electronic devices movable relative to each other, comprising:

an electric cable having end segments and a medial segment therebetween, each end segment connecting to one of the first and second electronic devices, a tensioning mechanism operative to maintain a tensile load on the medial segment of the electric cable in response to relative motion between the first and second electronic devices, a guide mechanism operative to guide the electric cable in response to relative motion between the first and second electronic devices, and a strain relief mechanism operative to mitigate the transmission of tensile loads from the medial segment to either of the end segments;

wherein the electric cable includes a plurality of individual connecting wires enclosed within a resilient sheath, and wherein each strain relief mechanism includes a structural flange connecting to a respective one of the electronic devices and a strain relief fitting, the strain relief fitting operative to direct tensile loads acting on the medial segment of the electric cable to pass through the strain relief fitting and into the structural flange.

2. The system according to claim 1 wherein the structural flange includes an aperture for accepting the strain relief fitting, wherein the strain relief fitting includes a notch for accepting the electric cable and a clamp restraint operative to engage the resilient sheath of the cable, and wherein the aperture of the structural flange defines an interference fit such that receipt of the strain relief fitting causes the clamp restraint to engage the resilient sheath and provide a load path into the structural flange.

3. The system according to claim 1 wherein the medial segment of the electric cable includes a pair of horizontal segments and a recurved vertical segment.

4. The system according to claim 3 wherein the guide mechanism includes a return pulley and a pair of right-angle guides, wherein the horizontal segments are connected to the recurved vertical segment, wherein the recurved vertical segment is guided by the return pulley, and wherein each of horizontal segments is guided to an end of the recurved vertical segment by a right angle guide.

5. The system according to claim 4 wherein the right angle guides include a rotating right-angle pulley and a non-rotating right-angle flange.

6. The system according to claim 1 wherein the electronic devices are separated along a separation path, and wherein the tensioning mechanism is a biasing device which applies a tensile load at a right angle relative to the separation path.

7. The system according to claim 6 wherein the biasing device is a coil spring.

8. The system according to claim 6 wherein the biasing device includes a resilient elastomer material.

9. The system according to claim 6 wherein the biasing device includes a pneumatic spring.

10. A cable connecting system for a mailpiece insertion system, the mailpiece insertion system having an integrated printer electrically connected to a mailpiece inserter, the printer being movable relative to the inserter along a separation path by a separation distance, the mailpiece insertion system comprising:

an electric cable having end segments and a medial segment therebetween, each end segment connecting to one of the printer and inserter, the electric cable, furthermore, having a length dimension equal or greater than to the separation distance;

a tensioning mechanism operative to maintain a tensile load on the medial segment of the electric cable in response to relative motion between the first and second electronic devices;

a guide mechanism operative to guide the electric cable in response to relative motion between the first and second electronic devices; and a strain relief mechanism disposed between each of the end segments and the medial segment to mitigate the transmission of tensile loads from the medial segment to either of the end segments;

wherein the electric cable includes a plurality of individual connecting wires enclosed within a resilient sheath, and wherein each strain relief mechanism includes a structural flange connecting to a respective one of the electronic devices and a strain relief fitting, the strain relief fitting operative to direct tensile loads acting on the medial segment of the electric cable to pass through the strain relief fitting and into the structural flange.

11. The cable connecting system according to claim 10 wherein the structural flange includes an aperture for accepting the strain relief fitting, wherein the strain relief fitting includes a notch for accepting the electric cable and a clamp restraint operative to engage the resilient sheath of the cable, and wherein the aperture of the structural flange defines an interference fit such that receipt of the strain relief fitting causes the clamp restraint to engage the resilient sheath and provide a load path into the structural flange.

12. The cable connecting system according to claim 10 wherein the medial segment of the electric cable includes a pair of horizontal segments and a recurved vertical segment.

13. The cable connecting system according to claim 12 wherein the guide mechanism includes a return pulley and a pair of right-angle guides, wherein the horizontal segments are connected to the recurved vertical segment, wherein the recurved vertical segment is guided by the return pulley, and wherein each of horizontal segments is guided to an end of the recurved vertical segment by a right angle guide.

14. The cable connecting system according to claim 13 wherein the right angle guides include a rotating right-angle pulley and a non-rotating right-angle flange.

15. The cable connecting system according to claim 10 wherein the tensioning mechanism is a biasing device which applies a tensile load at a right angle relative to the separation path.

16. The cable connecting system according to claim 15 wherein the biasing device is a coil spring.

17. The cable connecting system according to claim 15 wherein the tensioning and guide mechanisms are connected to the printer.

18. The cable connecting system according to claim 15 wherein the tensioning and guide mechanisms are connected to the inserter.

* * * * *